US011820632B2

(12) United States Patent
Kritzer et al.

(10) Patent No.: US 11,820,632 B2
(45) Date of Patent: Nov. 21, 2023

(54) TWO POST VEHICLE LIFT WITH COMPACT TELESCOPING ARMS

(71) Applicant: BendPak, Inc., Santa Paula, CA (US)

(72) Inventors: Jeffrey S. Kritzer, Moorpark, CA (US); Christopher Culver, Ventura, CA (US)

(73) Assignee: BendPak, Inc., Santa Paula, CA (US)

( * ) Notice: Subject to any disclaimer, the term of this patent is extended or adjusted under 35 U.S.C. 154(b) by 294 days.

(21) Appl. No.: 17/237,806

(22) Filed: Apr. 22, 2021

(65) Prior Publication Data

US 2021/0331904 A1 Oct. 28, 2021

Related U.S. Application Data

(60) Provisional application No. 63/014,407, filed on Apr. 23, 2020.

(51) Int. Cl.
*B66F 3/38* (2006.01)
*B66F 3/46* (2006.01)

(52) U.S. Cl.
CPC . *B66F 3/38* (2013.01); *B66F 3/46* (2013.01)

(58) Field of Classification Search
CPC ..... B66F 7/28; B66F 3/46; B66F 7/20; B66F 3/38; B66F 7/025; B25B 5/068; B25B 5/102; B25B 5/163; B25B 5/003; B25B 5/00
See application file for complete search history.

(56) References Cited

U.S. PATENT DOCUMENTS 4,715,477 A 12/1987 Suzuki
4,825,977 A 5/1989 Isogai
5,358,217 A * 10/1994 Dach ..... B66F 3/00 254/134
6,279,685 B1 8/2001 Kogan et al.
7,150,073 B2 12/2006 Stewart
8,256,577 B2 9/2012 Kritzer
9,150,395 B2 10/2015 Kritzer
2004/0011594 A1 1/2004 Stewart
2013/0233651 A1* 9/2013 Kritzer ..... B66F 3/46 187/208
2015/0232308 A1* 8/2015 Uhl ..... B66F 7/16 254/89 R
2016/0122168 A1 5/2016 Benz
(Continued)

FOREIGN PATENT DOCUMENTS

CN 202627602 U 12/2012
CN 202744279 U 2/2013
(Continued)

OTHER PUBLICATIONS

GrandPrix-Car-Lift-GP-7-Two-Post (Year: 2017).*

*Primary Examiner* — Mahdi H Nejad
(74) *Attorney, Agent, or Firm* — AVEK IP, LLC; Kent R. Erickson

(57) ABSTRACT

A compact telescoping lift arm assembly includes an outer arm section pivotally connected by a pivot member to a lift carriage vertically slidable on a post and an inner arm section telescopically received within the outer arm section and movable in and out of the outer arm section. The inner arm section has a nesting slot formed at an inner end thereof to nest about the pivot member when the inner arm section is retracted into the outer arm section.

29 Claims, 13 Drawing Sheets

(56) References Cited

U.S. PATENT DOCUMENTS

| | | | | |
|---|---|---|---|---|
| 2018/0327235 | A1* | 11/2018 | McClure | B66F 3/36 |
| 2019/0144249 | A1* | 5/2019 | Bartos | B66F 7/065<br>187/211 |
| 2020/0115206 | A1 | 4/2020 | Benz | |
| 2021/0114852 | A1* | 4/2021 | Heath | B66F 7/28 |

FOREIGN PATENT DOCUMENTS

| | | | | |
|---|---|---|---|---|
| CN | 103663267 | A | 3/2014 | |
| CN | 203845762 | U | 9/2014 | |
| CN | 203877864 | U | 10/2014 | |
| CN | 105036002 | A | 11/2015 | |
| CN | 204917853 | U | 12/2015 | |
| CN | 206970134 | U | 2/2018 | |
| CN | 207844837 | U | 9/2018 | |
| EP | 1156009 | A1 * | 11/2001 | B66F 7/28 |
| WO | 2014127238 | A2 | 8/2014 | |

* cited by examiner

TWO POST VEHICLE LIFT WITH COMPACT TELESCOPING ARMS

CROSS-REFERENCE TO RELATED APPLICATIONS

This application claims the benefit of U.S. Provisional Patent Application No. 63/014,407 filed Apr. 23, 2020 the disclosure of which is hereby incorporated herein in its entirety by reference.

BACKGROUND OF THE INVENTION

Field of the Invention

This invention relates to automobile service lifts and, more particularly, to a two post lift arrangement in which each post has a pair of compactly telescoping vehicle lift arms.

Background & Description of Related Art

A wide variety of post-type automobile lifts have been previously known and used in the automobile repair industry and by automotive enthusiasts to provide access to the undersides of vehicles. Post lifts can be either of the in-ground or above-ground variety. In-ground post lifts usually have one or two vertically ascending columns mounted below the floor of a service facility, such as a garage, shop, or the like that are raised hydraulically to lift the vehicle. Above-ground post lifts generally have two or four vertical columns or "posts", each of which includes a carriage that rides up and down the post. Each of the carriages includes a pair of inwardly extending lift arms with vehicle engagement pads at ends thereof that engage lift points or locations on the underside of a body or frame of a vehicle to be lifted.

Each post of such a vehicle lift typically has a pair of vehicle lift arms which are formed of telescoping sections and which are pivotally connected to the lift carriage which is slidably mounted on the post and selectively movable vertically on the post by a pressurized fluid cylinder connected between the lift carriage and the post, such as a hydraulic cylinder. The telescoping lift arm sections provide for a variety of lift arm lengths, and the pivotal connection of the arms to the lift carriage enable adjustment of the positions of the lift arms of the lift arrangement for use with a variety of vehicle sizes.

The lengths of the lift arms and their angular positions relative to the lift carriage is usually adjusted manually by a mechanic to position the lift pads for engagement with particular lift points of the vehicle. Once the weight of the vehicle is supported by the lift arms, friction between adjacent telescoping sections typically prevents changes in the lengths of the lift arms. However, it is generally preferred to fix the angular position of the lift arms prior to lifting.

A common lift arm angle locking mechanism includes an arcuate or curved movable or rotatable lock member mounted on an inner end of the lift arm which cooperates with a rotationally fixed position lock member mounted on the lift carriage. A typical movable lock member has circumferentially spaced teeth projecting radially outwardly about a pivot pin of the arm and has the appearance of a sector of a spur gear. The fixed lock member has an inwardly curved, toothed surface and is mounted on a lock pin. The lock pin is slidably mounted on the lift carriage and is urged by a spring toward a lowered locking position with the fixed lock engaging the movable lock. The lock pin may have a ring which is grasped by a mechanic to raise the lock pin to thereby retract the fixed lock member out of engagement with the movable lock member to enable pivoting of the lift arm. A representative type of such a vehicle lift arm locking mechanism is disclosed in U.S. Pat. No. 9,150,395 issued Oct. 6, 2015, the disclosure of which is incorporated herein in its entirety by reference. A typical fixed arm lock member has a much shorter circumference than the movable arm lock member, such that pivot forces applied to the engaged lock members are concentrated in small areas of the arm lock members.

A typical telescoping lift arm has an outer arm section which is pivotally connected to the lift carriage by a pivot pin. The lift arm may include a middle arm section telescoped within the outer arm section and may also include an inner arm section telescoped within the middle arm section. For this reason, the middle and inner arm sections have progressively smaller cross-sectional dimensions than the outer arm sections and are, thus, progressively weaker to the cantilever loads the lift arm is intended to support in lifting a vehicle. Accordingly, extension of the sections of a lift arm is typically limited, as by engagement of extension stop members on the arm sections to thereby limit the cantilever load on the arm sections. Retraction of the arm sections may also be limited by engagement of respective retraction stop members. In a typical telescoping lift arm, retraction of the middle and inner sections is ultimately limited by contact of inner ends of the middle and inner arm sections with the pivot pin of the lift arm.

SUMMARY OF THE INVENTION

The present invention provides embodiments of two post vehicle lift systems with compactly telescoping arms. An embodiment of a two post vehicle lift includes a pair of vehicle lift units positioned in spaced apart facing relation. Each lift unit includes an elongated upstanding lift post having a lift carriage slidably engaging and movable therealong. Each carriage includes a double ended lift arm supporting clevis extending inwardly of the post and having a pair of telescoping vehicle lift arms with inner or proximal arm ends thereof pivotally connected to the ends of the clevis in front-to-rear spaced relation. Each of the lift arms has telescoping arm sections, with a vehicle lift pad positioned at a distal arm end of the innermost arm section. The lift arms are telescopically extendible and retractable, and the lift arms are pivotable to enable the pads to be positioned in vertical alignment beneath lift points of a vehicle positioned between the posts of the vehicle lift system. Each post has a linear motor or actuator, such as a hydraulic cylinder, positioned therein and connected between the post and the lift carriage mounted therein. Coordinated operation of the lift cylinders enables selective raising and lowering of a vehicle supported by the lift arms of the lift units.

In an embodiment of the lift system, each lift arm includes: an outer arm section having an inner end pivotally connected to a lift carriage by a lift arm pivot member such that the outer arm section is pivotal about a pivot axis extending through the lift arm pivot member; an inner arm section telescopically received within the outer arm section to enable extension of the arm assembly by extension of the inner arm section out of the outer arm section and retraction of the arm assembly by retraction of the inner arm section within the outer arm section; the inner arm section having an inner end within the outer arm section and an outer end extending out of the outer arm section; and the inner end of the inner arm section having a nesting recess positioned such that the inner end extends past the pivot member, with the pivot member nested in the recess, when the inner arm section is fully retracted within the outer arm section. The nesting recess may be formed by a nesting slot which is open through the inner end of the inner arm section. Alternatively, the inner arm section may form an intermediate arm section received within the outer arm section and having the nesting recess formed therein, and an interior arm section sleeved therein with or without a nesting recess at an inner end thereof.

In an embodiment of the lift system, each lift arm includes an outer arm section, an intermediate arm section, and an inner arm section. The outer arm section is pivotally connected to an end of the clevis by a pivot member, such as a pivot pin or tube. The intermediate arm section is sleeved within the outer arm section and has a nesting slot formed at an inner end thereof which enables the intermediate arm section to be retracted such that the actual end of the intermediate arm section slides past the pivot member with the pivot member nested within the slot. The inner arm section is sleeved within the intermediate arm section and has a vehicle lift pad positioned at an outer end thereof for engagement with a lift point of a vehicle to be lifted. It is foreseen that the inner arm section could also have a nesting slot at an inner end thereof similar to the nesting slot of the intermediate arm section and for a similar purpose. The nesting slot or slots enable the lift arm to be retracted to a greater extent than would be possible without the slot or slots. The arm sections of the lift arm may have guide members to enable smooth movement of the arm sections in extending and retracting the arm sections. Additionally, stop members are preferably provided to limit outward and inward movement of the intermediate and inner arm sections.

For safe operation of the lift system, it is desirable for the angular positions of the lift arms to be locked during raising and lowering of a vehicle supported by the lift arms. In an embodiment of the system, a rotatable pivot lock member is secured to an inner end of the outer section of a lift arm and is selectively engaged by a rotationally fixed pivot lock member mounted on the clevis of the lift carriage.

The rotatable lock member may be a rotatable lock gear secured to a surface of an inner end of the outer arm section in coaxial relation to a lift arm pivot member or lift arm pivot axis about which the lift arm pivots. The rotatable lock gear rotates about the arm pivot axis as the lift arm is pivoted. The rotatable lock gear may have the form of a spur gear with rotatable lock gear teeth projecting radially from substantially an entire outer circumferential surface of the rotatable lock gear or substantially 360 degrees about the rotatable lock gear. The rotationally fixed pivot lock member may be a rotationally fixed lock gear having the form of an internally toothed ring gear with rotationally fixed gear teeth projecting radially inwardly from substantially an entire inner circumferential surface of the rotationally fixed lock gear or substantially 360 degrees about the rotationally fixed lock gear. The rotationally fixed lock gear is slidably mounted on the clevis of the lift carriage in coaxially spaced relation to the lift arm pivot axis to enable the rotationally fixed lock gear to transition between a locked or meshed position and an unlocked or unmeshed position. In the meshed position, the rotationally fixed gear teeth mesh with the rotatable gear teeth to prevent pivoting of the lift arm about the pivot axis. In the unmeshed position, the rotationally fixed gear teeth are separated from the rotatable gear teeth, thereby enabling the lift arm to pivot relative to the clevis.

The rotationally fixed lock gear is prevented from rotating relative to the lift carriage by a lock guide rod or lock pin which is slidably mounted on the lift carriage clevis. The lock pin also functions as a release member by enabling the rotationally fixed lock gear to be transitioned to the unlocked position from the locked position. A lock pin spring is engaged between the lock pin and the clevis and normally urges the lock pin toward the locked position. The lock pin is moved axially to transition the rotationally fixed lock gear to the unlocked position and released to enable the rotationally fixed lock gear to return to the locked position. In an embodiment of the lift system, a lock pin lever is engaged between the lock pin and the clevis to facilitate operation of the lock pin.

Because of the lengths of the lift arm assemblies, any horizontal force on the distal end of a lift arm assembly, which tends to pivot the arm assembly about its axis, can place very high levels of forces on the lock pin lever when the rotationally fixed lock gear is in the locked position. In order to limit strain and possible deformation of the lock pin, abutment members may be positioned within the lift carriage clevis, in close proximity to the rotational fixed lock gear of each lift arm assembly. The abutment members limit movement of portions of the rotationally fixed lock gear near the lock pin in reaction to forces acting on the distal end of a lift arm assembly to thereby limit strain transferred to the lock pin by engagement of the rotationally fixed lock gear with the associated abutment members. A rear wall of the lift carriage clevis can form an abutment member in one direction about the pivot axis. An abutment wall or plate can be secured within the lift carriage clevis in close proximity to the rotationally fixed lock member to form an abutment member in the opposite direction about the pivot axis. The spacing between the abutment members should be adequate to avoid binding to movement of the rotationally between the locked and unlocked positions, while limiting strain on the lock pin. Within a lift carriage clevis, two abutment plates may be secured in spaced relation for the two lift arm assemblies. A reinforcement plate extending between the two abutment plates may be provided.

Various objects and advantages of the present invention will become apparent from the following description taken in conjunction with the accompanying drawings wherein are set forth, by way of illustration and example, certain embodiments of this invention.

The drawings constitute a part of this specification, include exemplary embodiments of the present invention, and illustrate various objects and features thereof.

DETAILED DESCRIPTION OF THE PREFERRED EMBODIMENTS

Figure 1:
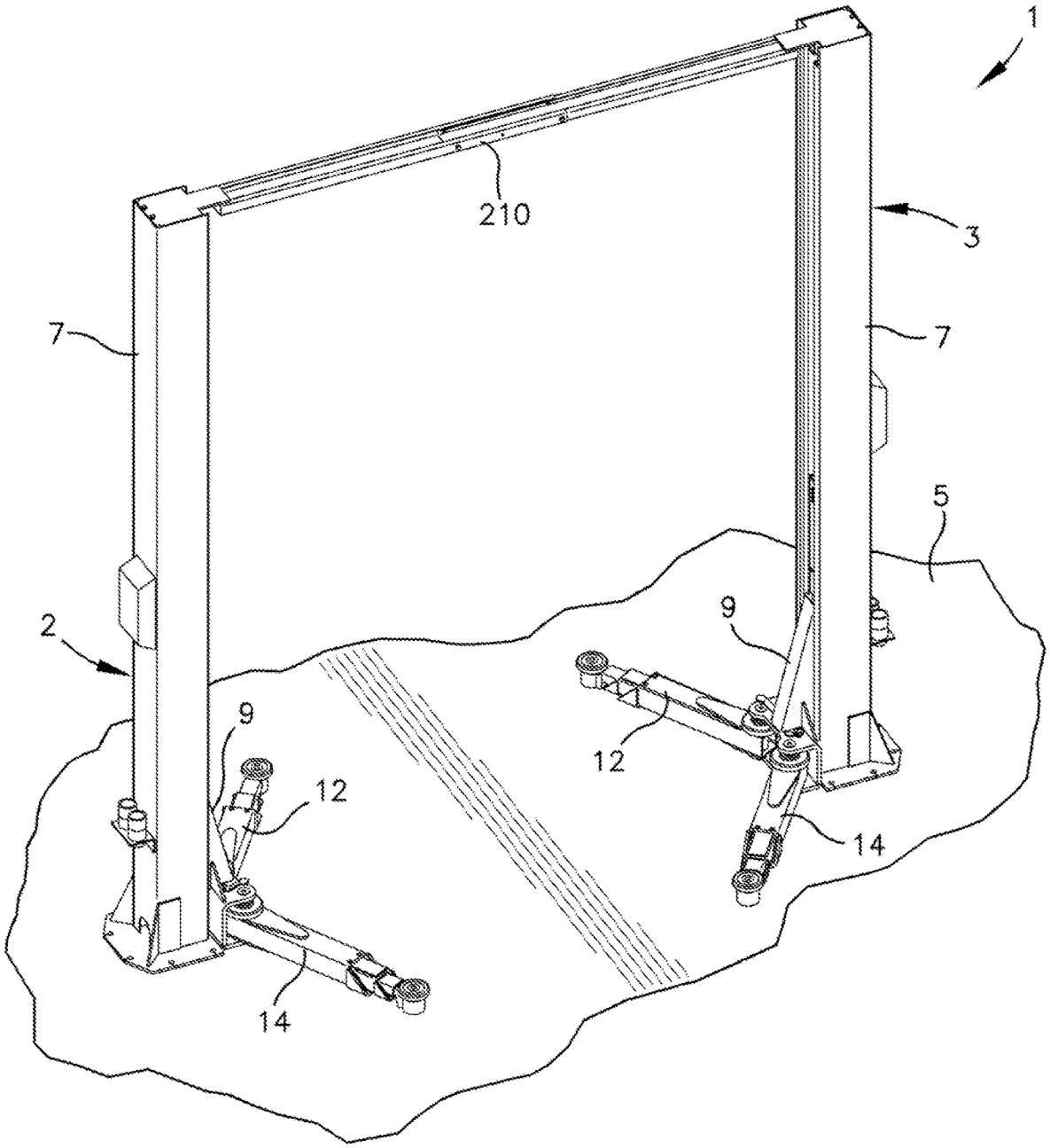
FIG. 1 is a perspective view of an embodiment of a two post vehicle lift system with compactly telescoping arms, according to the present invention.
Figure 2:
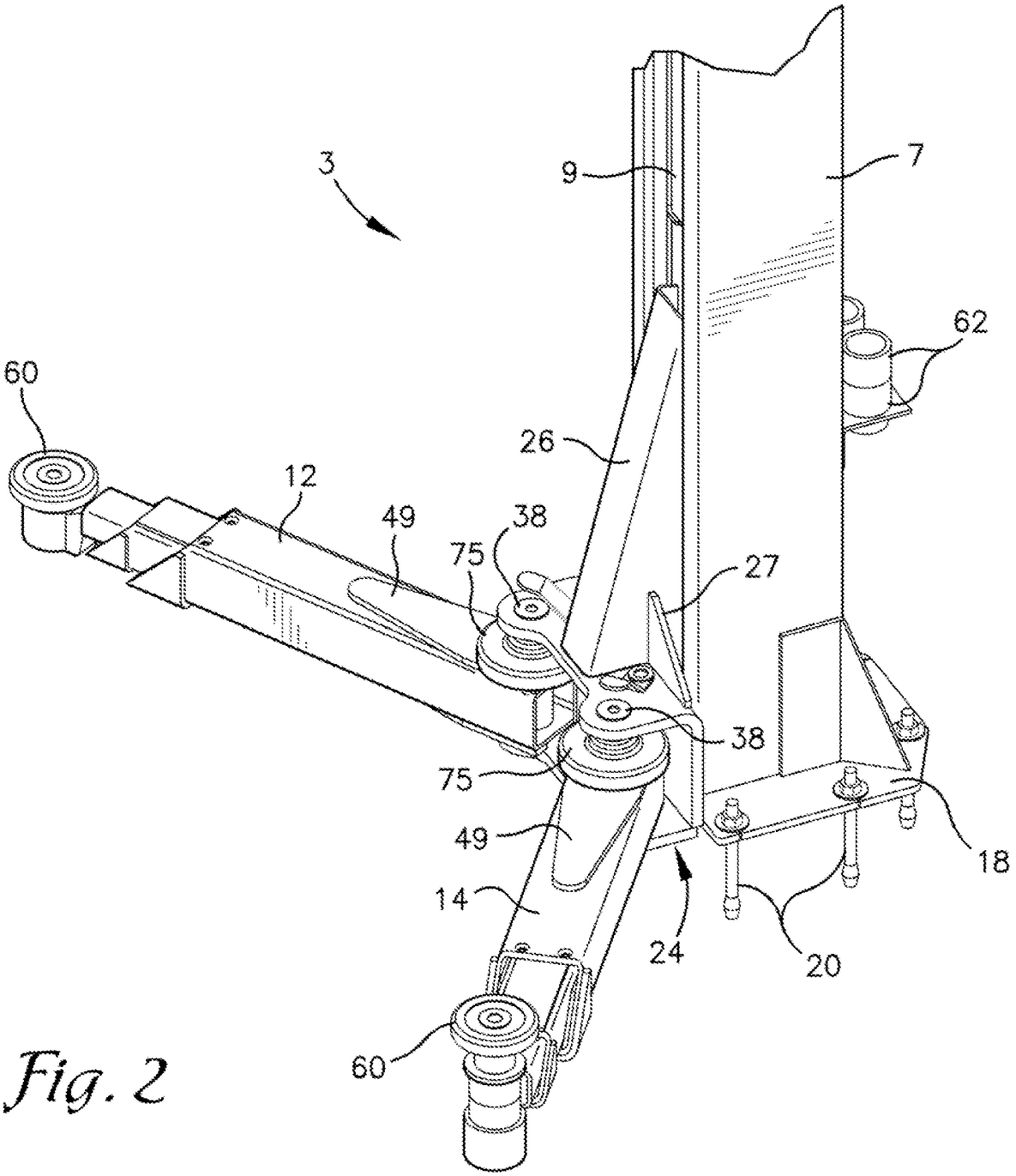
FIG. 2 is an enlarged fragmentary perspective view of a lift unit of the lift system.
Figure 3:
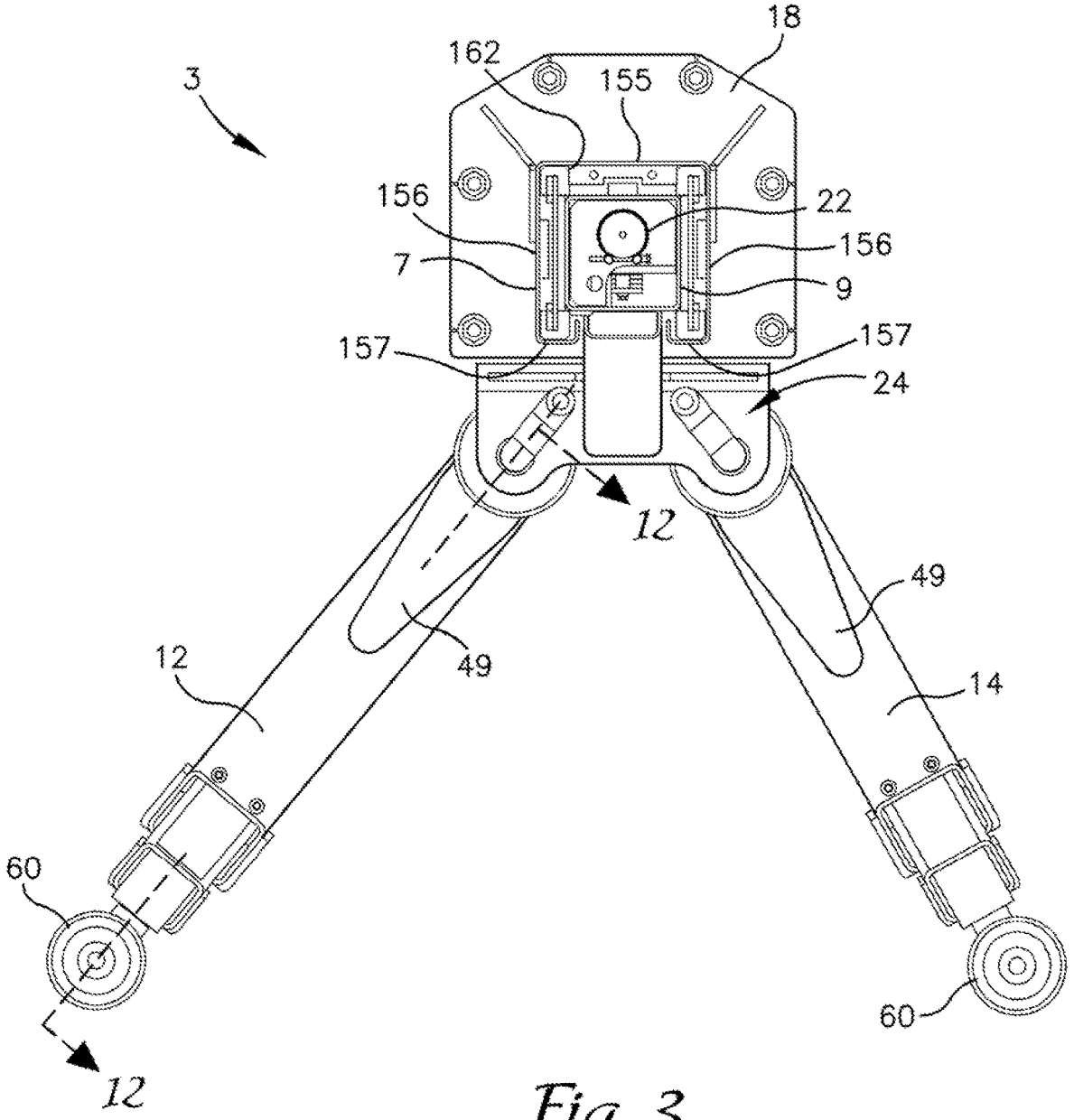
FIG. 3 is a top plan view of a lift unit of the lift system.
Figure 4:
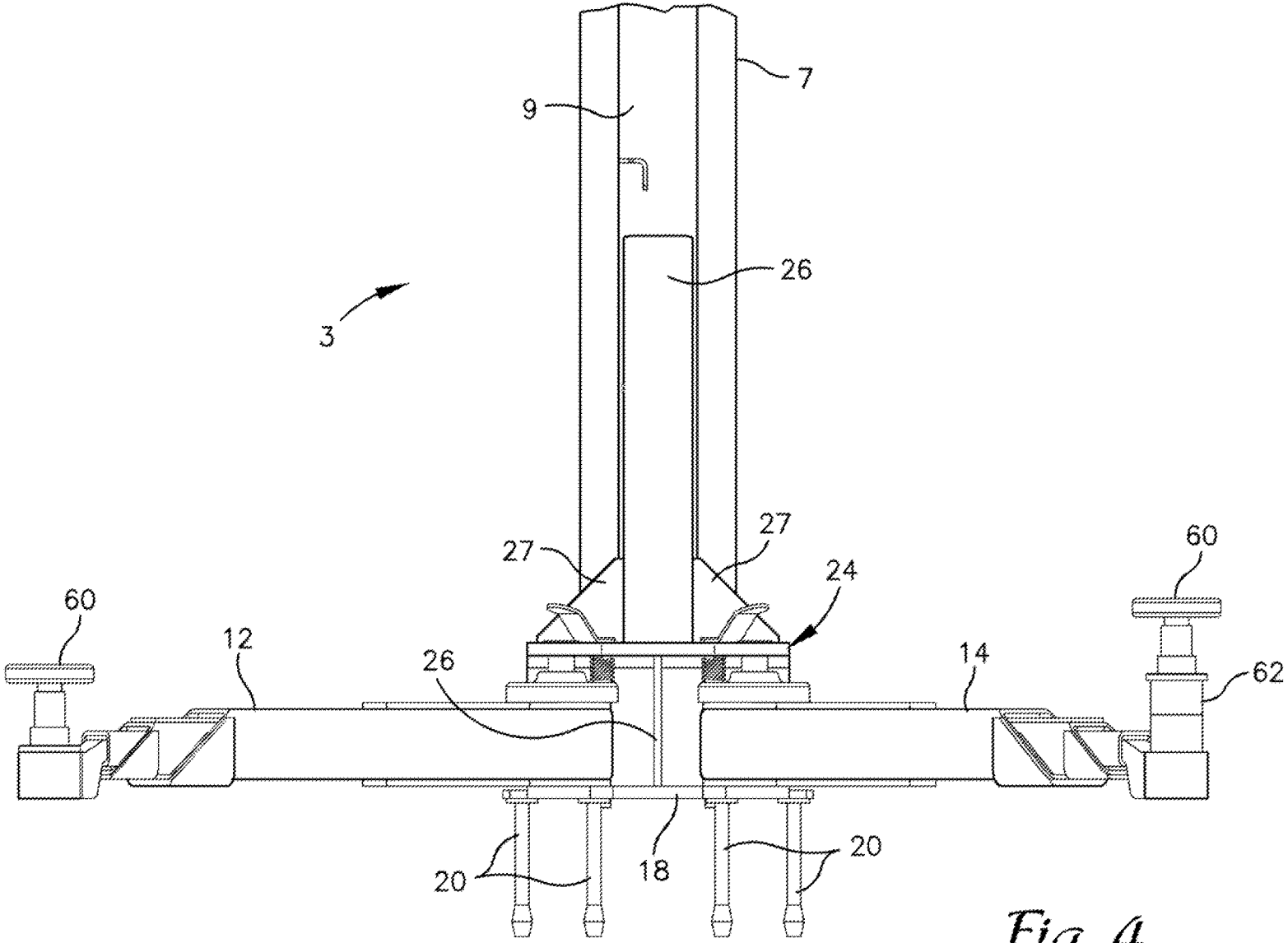
FIG. 4 is a further enlarged fragmentary inside elevational view of the lift unit of the lift system.
Figure 5:
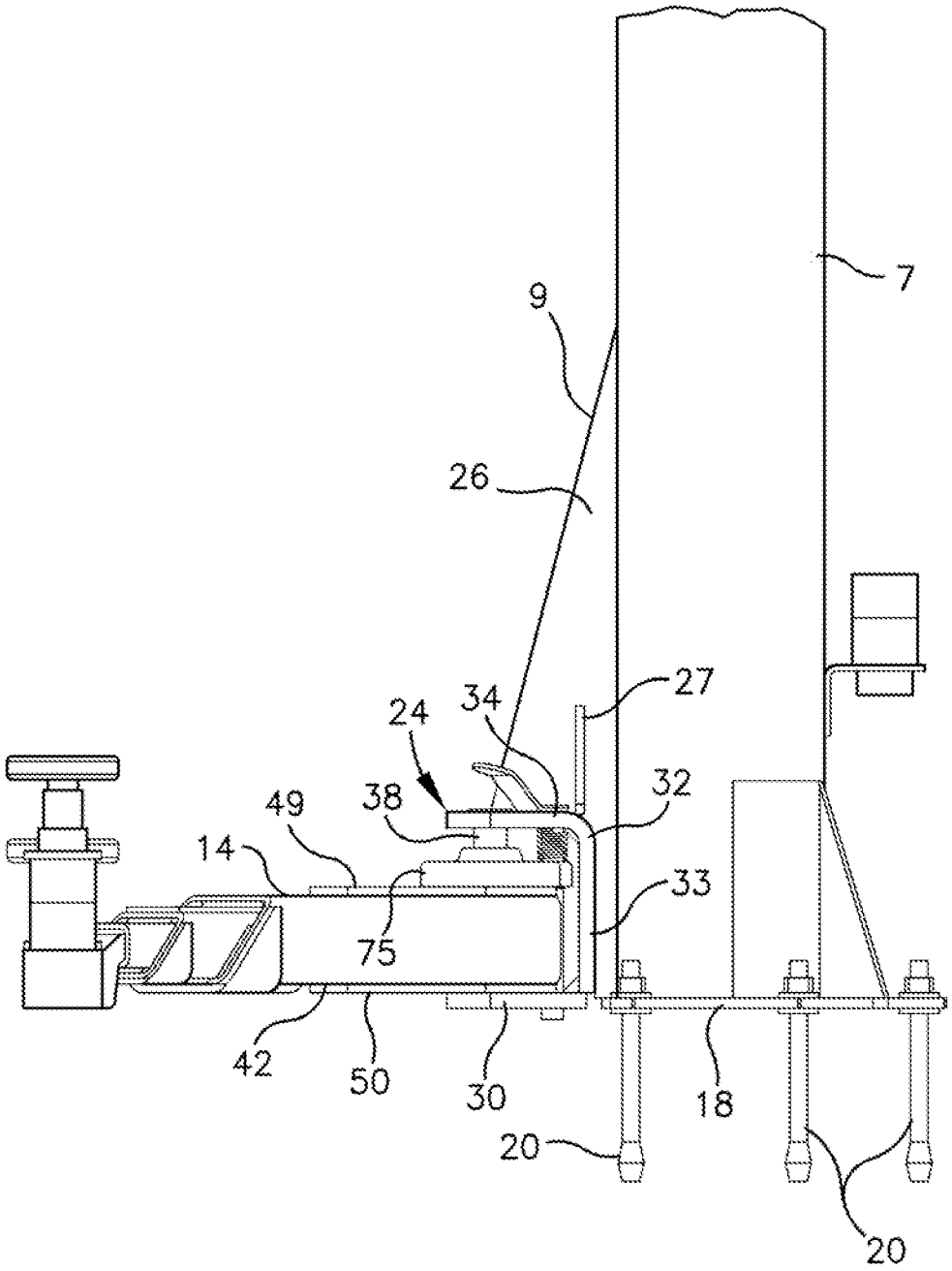
FIG. 5 is a further enlarged front side elevational view of the lift unit of the lift system.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure Referring to the drawings in more detail, the reference number 1 generally designates an embodiment of a two post vehicle lift system according to the present invention. Referring to FIG. 1, the system 1 generally includes a pair of vehicle lift units 2 and 3 positioned in mutually facing relation on a floor 5 of a vehicle service facility, such as a garage, shop, or the like. Each of the lift units 2 and 3 includes an elongated upstanding post 7 having a vehicle lift carriage 9 slidably mounted thereon to enable lifting and lowering of a vehicle, for inspection, service, or the like. Each of the lift carriages 9 has a pair of telescoping vehicle lift arms 12 and 14 pivotally mounted thereon to enable positioning for engagement with a vehicle to be lifted.

Referring to FIGS. 2-5, the illustrated post 7 is supported on a base plate 18 which is secured to the shop floor 5 by a plurality of bolts 20 spaced about a periphery of the base plate 18. The lift carriage 9 is illustrated as an elongated tubular structure which is slidably mounted within the post 7. The carriage 9 is translated vertically along the post 7 by operation of a linear motor or actuator, such as a hydraulic cylinder 22 (FIG. 3) connected between the post 7 and the carriage 9. The carriage 9 has a double ended lift arm support clevis 24 secured thereto at a lower end thereof and reinforced by a center gusset member 26 and end gussets 27. The clevis 24 may be formed by a clevis bottom plate 30 (FIG. 5) having an inverted L-shaped clevis bracket 32 joined thereto to form a generally C-shaped structure. The illustrated clevis bracket 32 has a vertical clevis side plate 33 and a horizontal clevis top plate 34. The illustrated clevis 24 has openings in the top plate 34 and bottom plate 30 to receive vertically oriented lift arm pivot pins 38 (FIG. 5) on which the lift arms 12 and 14 pivot.

The lift units 2 and 3 are substantially similar and may be designated as a left hand lift unit 2 and a right hand unit 3. The lift arms 12 and 14 may be substantially similar in construction and operation and may be designated as a rear lift arm 12 and a front lift arm 14. Thus, description of components and interaction thereof for the rear lift arm 12 corresponds to similar components of the front lift arm 14. In the lift unit 3, as illustrated particularly in FIG. 3, the front lift arm 14 is somewhat shorter than the rear lift arm 12. The purpose for the difference in the length of the lift arms 12 and 14 is to better balance the weight of modern vehicles on the lift system 1. Modern vehicles, particularly passenger vehicles, tend to be heavier in front because of the location of the transmission and transaxle, as wells as the engine, toward the front of the vehicle. Thus, the shorter front lift arms 14 position the front end of a vehicle closer the posts 7. It is foreseen that the lift arms 12 and 14 could alternatively be of equal lengths.

Figure 6:
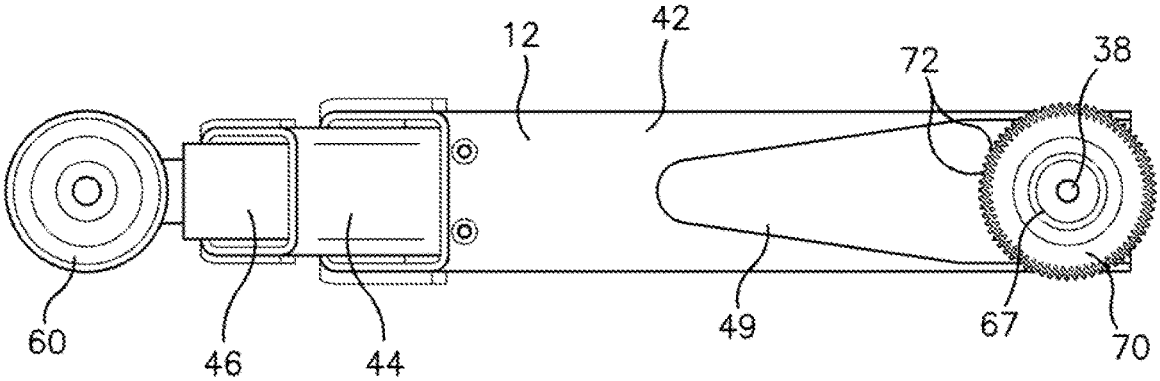
FIG. 6 is a further enlarged top plan view of a lift arm of the lift unit, with a portion removed to illustrate details thereof.
Figure 7:
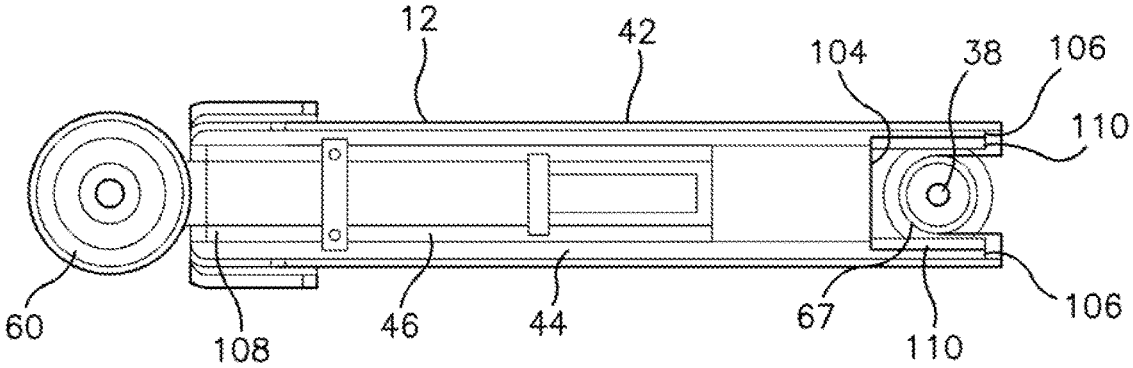
FIG. 7 is an enlarged fragmentary top plan view of a lift arm of the lift unit with an upper wall of an external arm section removed to illustrate a nesting slot formed at an inner or proximal end of a middle arm section in relation to a mounting tube of the lift arm.

Referring to FIGS. 6 and 7, the illustrated telescoping lift arm 12 includes an outer lift arm section 42, an intermediate or middle lift arm section 44, and an inner or interior lift arm section 46. The middle arm section 44 is sleeved within the outer arm section 42, and the inner arm section 46 is sleeved within the middle arm section 44. The lift arm sections 42-46 may be formed of lengths of rectangular or square cross section tubular beams of appropriate sizes or may built up from components such as channels, plates, and the like which are joined, as by welding. The outer arm section 42 may be reinforced by an upper stiffener 49 and a lower stiffener 50 (FIGS. 10 and 11) joined respectively to an upper surface and a lower surface of the outer arm section 42.

Figure 10:
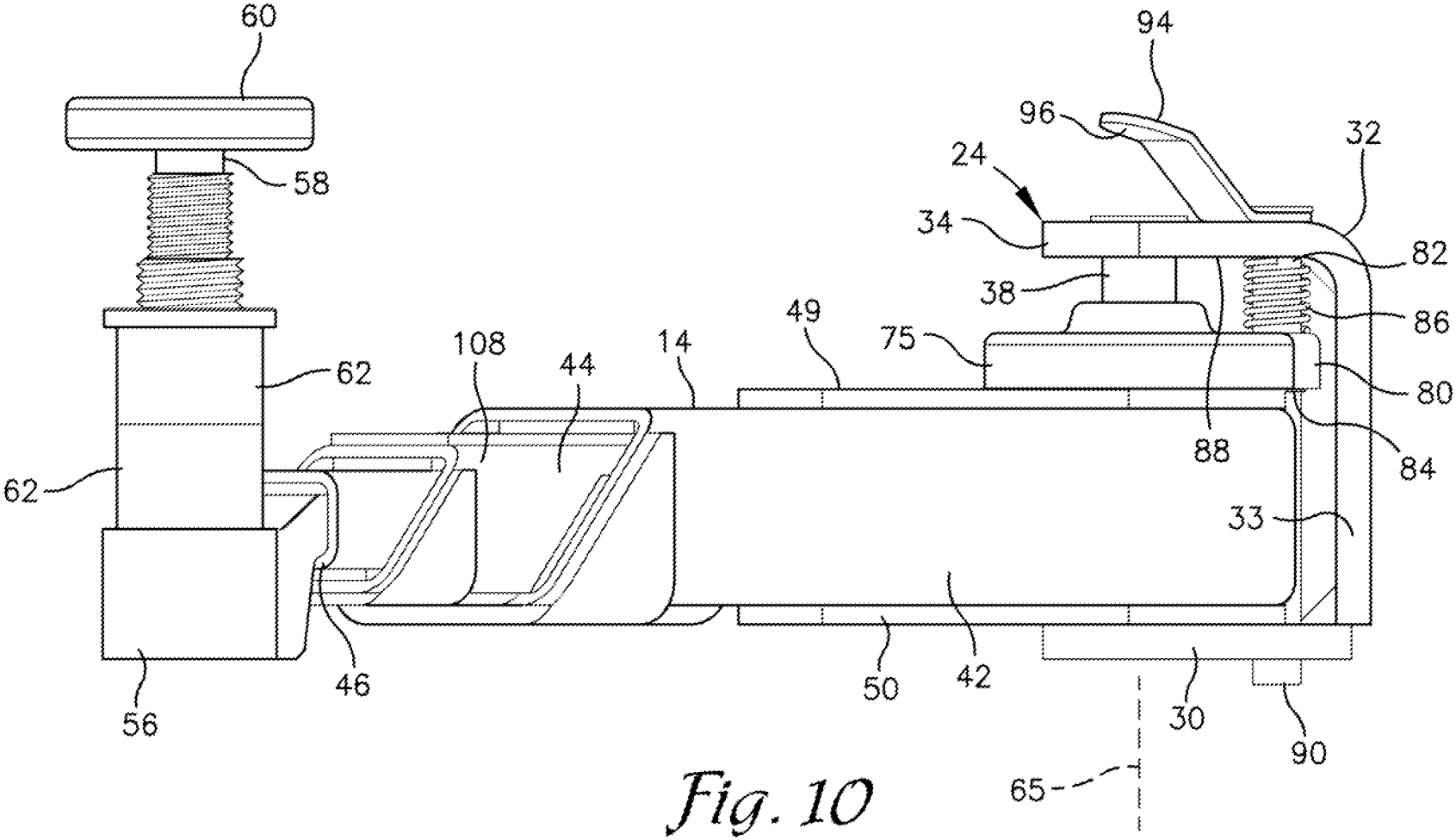
FIG. 10 is a further enlarged front elevational view of a retracted front lift arm and illustrates the rotationally fixed arm lock gear in a lowered arm locking, meshed position.
Figure 11:
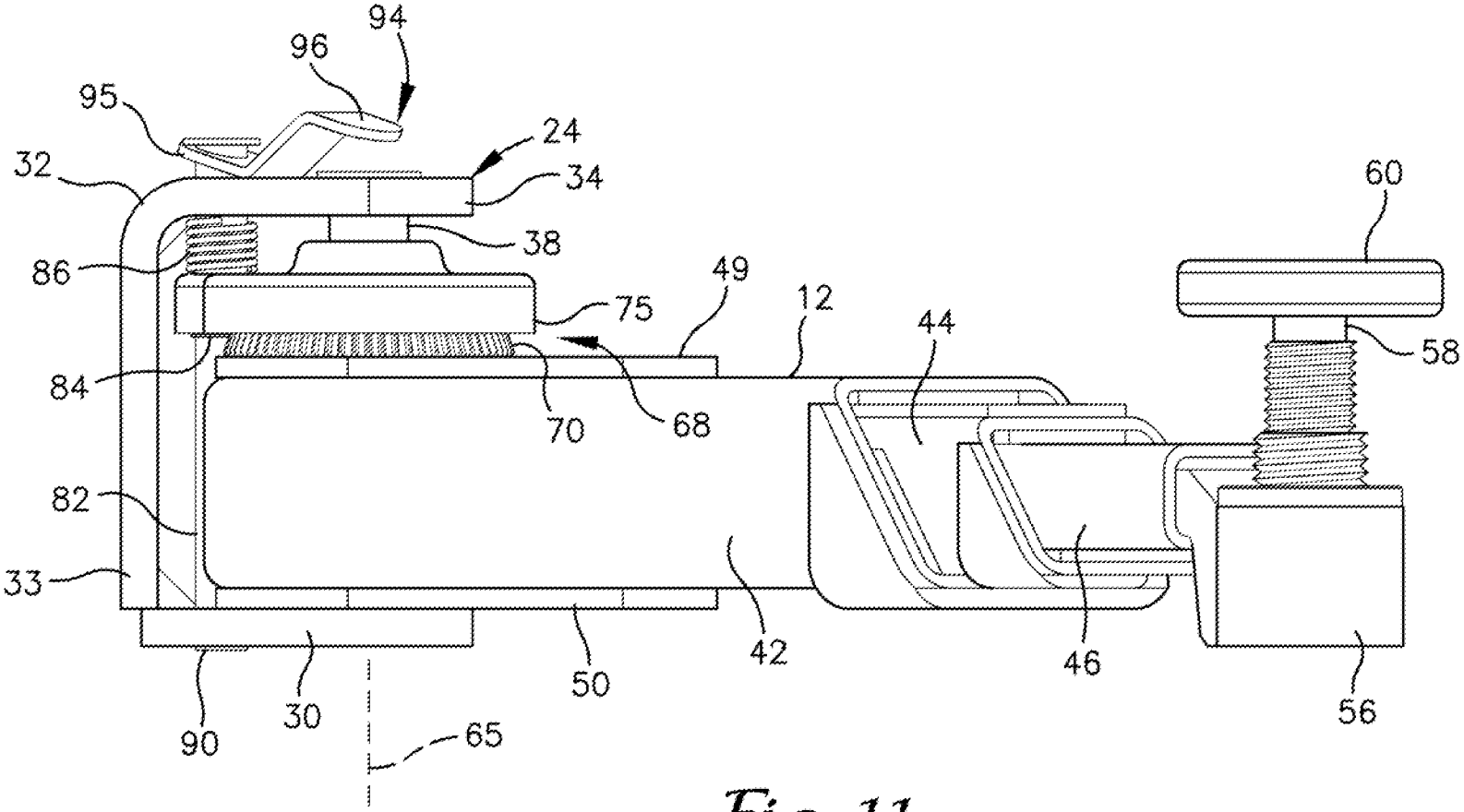
FIG. 11 is a rear elevational view of a retracted rear lift arm and illustrates the rotationally fixed arm lock gear in a raised arm unlocking, unmeshed position.

Referring to FIGS. 10 and 11, an outer end of the inner arm section 46 is provided with a lift pad adapter 56 configured to receive a lift pad assembly 58 having a lift pad 60 positioned at a top end thereof. The lift pad assembly 58 may include one or more extensions 62 (FIG. 10) to position the lift pad 60 at a desired height. The lift pad 60 forms a contact element between the lift arm 12 and a lift point of a vehicle to be lifted.

The lift arm 12 is pivotally connected to the lift arm clevis 24 for pivoting about a vertical lift arm pivot axis 65 (FIGS. 10 and 11). In the illustrated arm 12, a lift arm mounting tube or bushing 67 (FIGS. 6 and 7) extends through the upper and lower walls of the outer arm section 42 and through the upper and lower stiffeners 49 and 50 and is joined to those elements, as by welding. The mounting tube 67 is sleeved onto the lift arm pivot pin 38, which is secured in a vertical orientation within the clevis 24 and, in cooperation with the pivot pin 38, forms a pivotal bearing for the lift arm 12 relative to the clevis 24.

Figure 8:
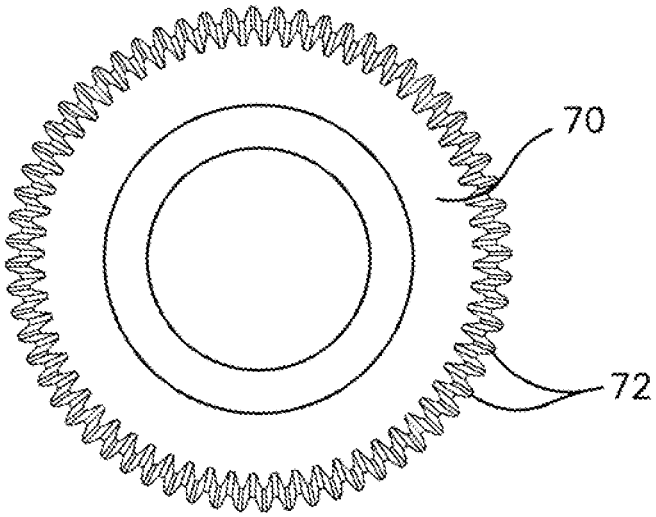
FIG. 8 is a greatly enlarged top plan view of a rotatable arm lock gear of a lift arm of the lift unit.
Figure 9:
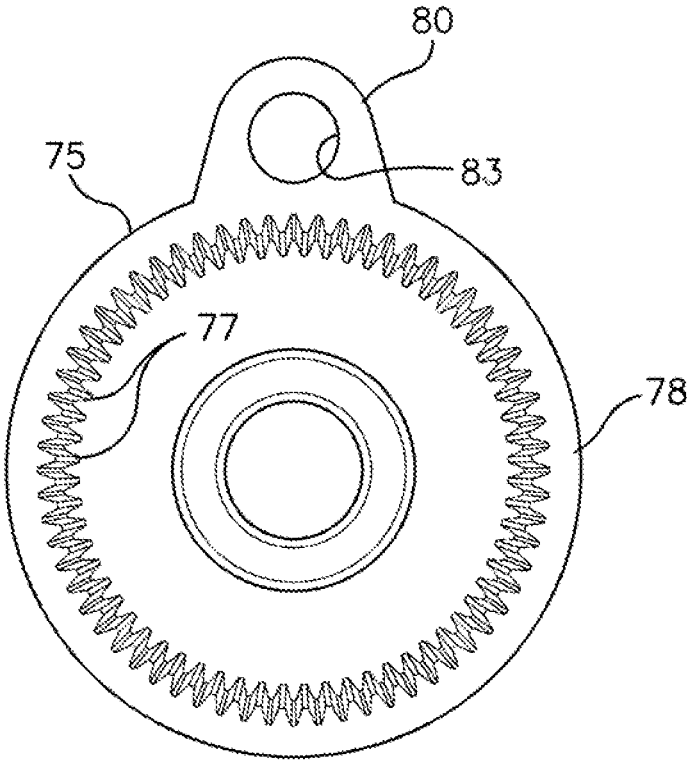
FIG. 9 is a greatly enlarged bottom plan view of a rotationally fixed arm lock gear of a lift arm of the lift unit.

It is generally desirable to positively fix the angular position of the lift arms 12 and 14, especially, prior to lifting a vehicle. The illustrated lift arms 12 and 14 include a lift arm rotational lock mechanism 68 (FIG. 11) to enable releasable fixing of the angular relation of the arms 12 and 14 to the clevis 24 of the lift carriage 9. In the illustrated system 1, the arm lock mechanism 68 of each of the lift arms 12 or 14 includes a rotatable lift arm pivot lock member or gear 70 secured to the outer arm section 42 in coaxially aligned relation to the mounting tube 67 and, thus, with the pivot pin 38 and the pivot axis 65. As shown in FIG. 11, the rotatable lock gear 70 may be fixedly secured to the upper arm stiffener 49 of the outer arm section 42 and rotates about the pivot axis 65 as the lift arm 12 or 14 is pivoted about the pivot axis 65. As shown in FIGS. 8 and 11, the rotatable gear 70 has the form of a circular spur gear with rotatable gear teeth 72 projecting radially outward therefrom and spaced circumferentially about substantially an entire outer surface of the gear 70 or substantially 360 degrees about the rotatable lock gear 70. Additionally, in the illustrated rotatable gear 70, bottom and top lands of the gear teeth 72 have a conical relationship to an axis of the rotatable lock gear 70.

Figure 12A:
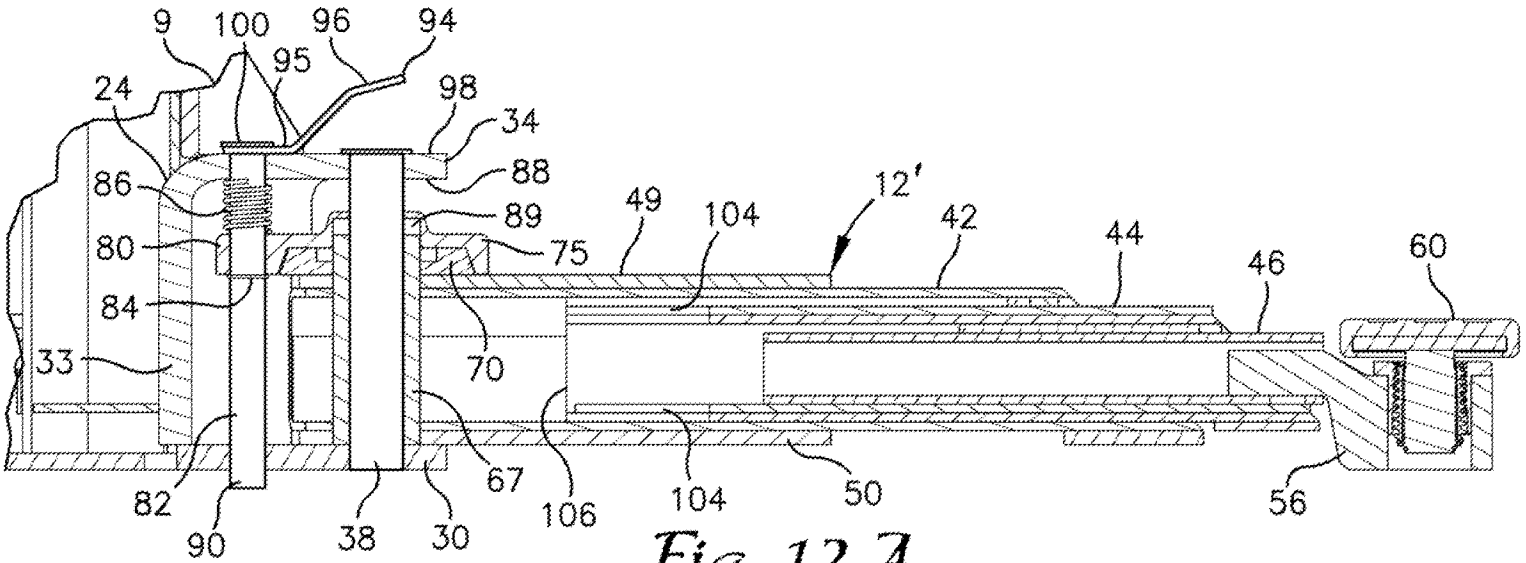
FIG. 12A is an enlarged fragmentary cross sectional view through a somewhat modified lift arm, taken along a section plane indicated by line 12-12 of FIG. 3, and shows the release lever, lock pin, and rotationally fixed arm lock gear in the lowered arm locking, meshed positions thereof.
Figure 12B:
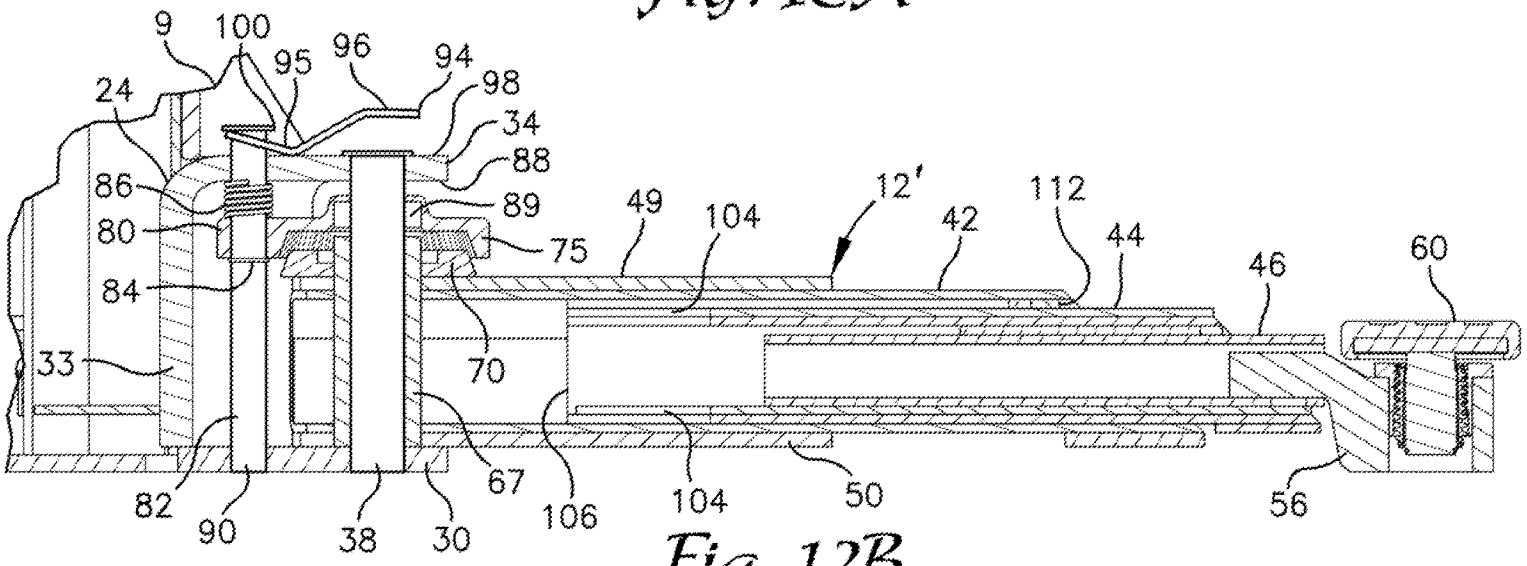
FIG. 12B is a view similar to FIG. 12A and shows the release lever, lock pin, and rotationally fixed arm lock member in the raised arm unlocking, unmeshed positions thereof.
Figure 13:
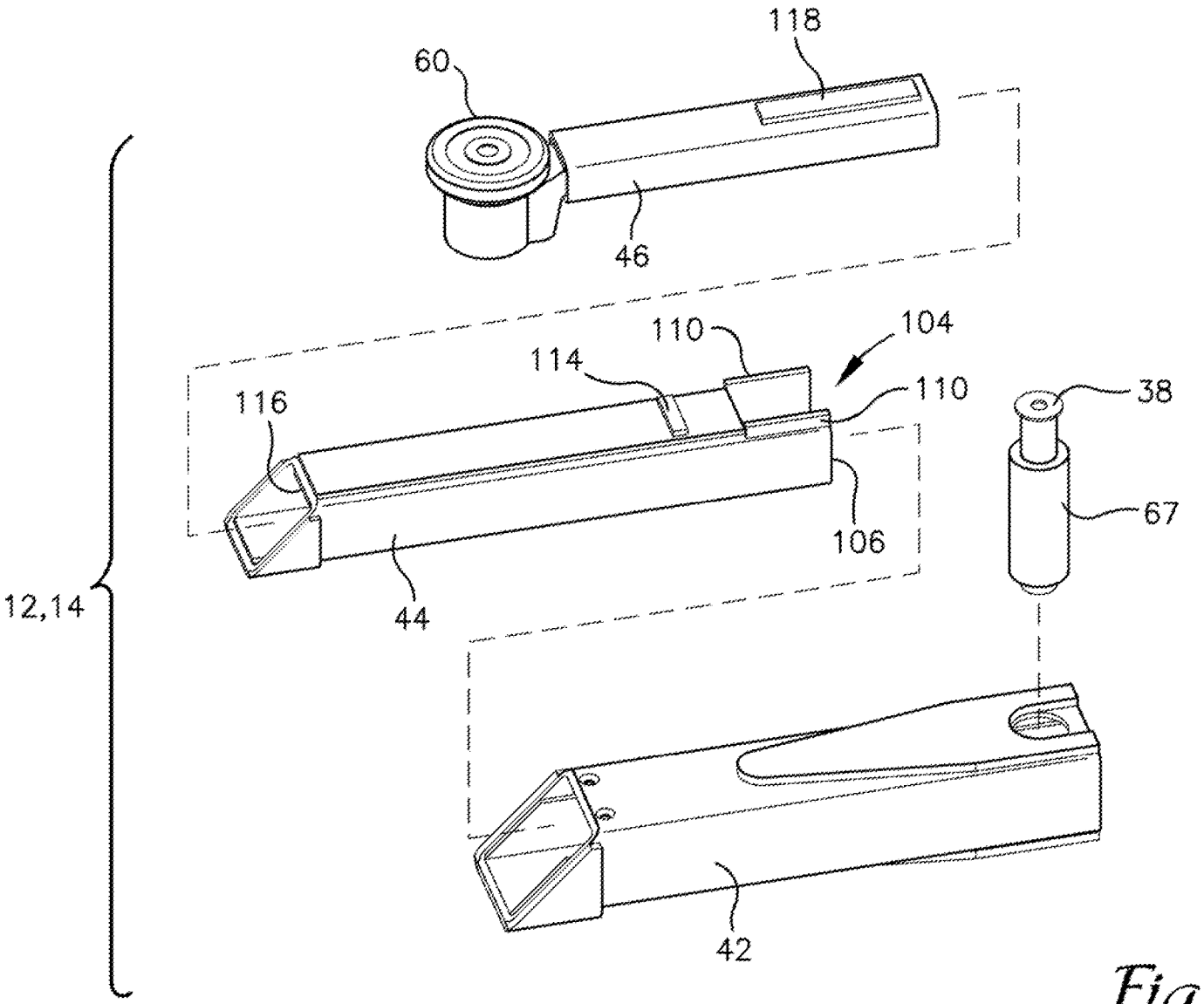
FIG. 13 is an exploded perspective view of a lift arm of a lift unit and illustrates cooperation of an inner end slot of the middle arm section with a pivot member of the lift arm.

FIGS. 12A and 12B illustrate a lift arm 12' which is somewhat modified in construction compared to the lift arms 12 and 14. The lift arm 12' is structurally and functionally similar to the lift arms 12 and 14, and corresponding components thereof will be identified by the same reference numerals as components of the lift arms 12 and 14.

Referring to FIGS. 9 and 11-12B, the arm lock mechanism 68 of the arms 12 and 14 includes a rotationally fixed lift arm pivot lock member or gear 75, illustrated as slidably received on the pivot pin 38 in covering relation to the rotatable lock gear 70 and rotationally fixed by connection to the lift carriage clevis 24. The rotationally fixed gear 75 is illustrated as an internal ring gear having a plurality of radially inwardly projecting rotationally fixed teeth 77 from substantially an entire inner surface of an outer circumferential flange 78 of the gear 75 or substantially 360 degrees about the rotationally fixed gear 75. Bottom and top lands of the gear teeth 77 have a conical relationship to an axis of the rotationally fixed gear 75 and are sized to compatibly mesh with the gear teeth 72 of the rotatable gear 70.

The illustrated rotationally fixed gear 75 has a rotationally fixed lock gear mounting lug 80 extending radially therefrom. The mounting lug 80 is slidably received onto a lock guide rod or lock pin 82 extending through a bore 83 formed through the lug 80 and positions the rotationally fixed gear 75 in radially spaced relation to the lock pin 82. The lock pin 82 is mounted on the clevis 24 for vertical reciprocating movement in relation thereto. Both the pivot pin 38 and the lock pin 82 are mounted on the clevis 24 such that lateral movement of both is prevented. Thus, rotation of the rotationally fixed gear 75 is prevented by its mounting on the pivot pin 38 and the lock pin 82. However, the rotationally fixed gear 75 is free to move axially along the pivot pin 38. Relative movement of the mounting lug 80 and the gear 75 on the lock pin 82 is limited by means such as a snap ring 84 positioned below the lug 80 on the lock pin 82. A compression spring 86 is sleeved onto the lock pin 82 between the mounting lug 80 and a bottom surface 88 of the clevis top plate 34. Engagement of the spring 86 with the bottom surface 88 of the clevis top plate 34 resiliently urges the lock pin 82 downwardly.

The lock pin 82 is movable vertically between a lower pivot lock position (FIGS. 10 and 12A) and a raised pivot release position (FIGS. 11 and 12B). In the lock position of the lock pin 82, the rotationally fixed lock gear 75 is meshed with the rotatable lock gear 70, preventing rotation thereof, to thereby prevent angular movement of the lift arm 12 or 14 or 12' relative to the clevis 24. As shown in FIGS. 12A and 12B, the rotationally fixed gear 75 may have an annular recess 89 on an underside thereof to enable the gear 75 to extend over and about an upper end of the mounting tube 67 in the locked position of the gear 75. In the release position of the lock pin 82, the rotationally fixed gear 75 is lifted out of meshing relation with the rotatable gear 70, thereby enabling rotation thereof, to thereby enable the lift arm 12 or 14 or 12' to pivot about the associated pivot pin 38. It should be noted that the lock pin 82 has a lower end 90 which extends below a lower surface of the bottom plate 30 of the clevis 24, such that when the lift carriage 9 is lowered to the shop floor 5, contact of the lock pin lower end 90 with the floor 5 causes the lock pin 82 to lift the rotationally fixed gear 75 out of meshed engagement with the rotatable gear 70, thereby releasing the lift arm 12 or 14 or 12' to freely pivot about the pivot pins 38.

In order to facilitate movement of the lock pin 82 to the release position, the illustrated lift system 1 is provided with a release handle or lever 94 engaged with the lock pin 82 and operable to lift the lock pin 82 to the release position (FIG. 11). The illustrated release lever 94 is of a stretched Z-shape having a lower flat end 95 and an upper flat end 96. The lower end 95 is retained on the lock pin 82 between an upper surface 98 of the top plate 34 of the clevis 24 and a top end washer 100 fixed to a top end of the lock pin 82. Downward pressure on the upper end 96 of the release lever 94 causes the lower end 95 thereof to engage the washer 100 to thereby lift the lock pin 82 from its lower lock position to its upper release position, to thereby lift the rotationally fixed gear 75 out meshing engagement with the movable gear 70 to enable the lift arm 12 or 14 or 12' to be pivoted about the associated lift arm pivot axis 65. When the upper end 96 of the lever 95 is released, the compression spring 86 and gravity return the lock pin 82 to the lock position with the rotationally fixed gear 75 enmeshed with the movable gear 70, thereby preventing pivoting of the lift arm 12 or 14 or 12' relative to the clevis 24.

The lift arm sections 42-46 may include guide members (not shown) to facilitate smooth extension and retraction of the middle and inner arm sections 44 and 46 relative to the outer arm section 42 and therebetween. It is necessary to limit the degree of extension of the middle and inner lift arm sections 44 and 46 from the outer lift arm section 42 to avoid exceeding cantilever loading limits of the arm sections 42-46. Therefore, the middle and inner arm sections 44 and 46 preferably include appropriate stops (not shown) to limit extension of the lift arm 12 or 14 or 12'. On the other hand, it is preferable to retract the middle and inner arm sections 44 and 46, as far as is practical, so that the lift arm assemblies 12 or 14 or 12' is as compact as possible when retracted. Usually, the limit of retraction of the arm sections 44 and 46 is engagement of inner ends thereof with the pivot members of the lift arm 12 or 14 or 12'.

Referring to FIGS. 7, 12A and 12B, and 13, in the illustrated embodiment of the vehicle system 1, the middle lift arm section 44 has a pivot tube nesting recess or slot 104 formed at an inner end 106 thereof which enables inner end 106 of the middle arm section 44 to be retracted past the mounting tube 67, with the mounting tube 67 positioned in or nesting within the slot 104. The presence of the nesting slot 104 allows the middle arm 44 to be somewhat longer than otherwise possible while enabling an outer end 108 to be retracted to the same degree as a shorter middle arm section 44 without the slot 104. It is foreseen that the inner arm section 46 could also be provided with a nesting slot similar to the nesting slot 104 for the same purpose, that is, to allow more compact retraction of the inner arm section 46 within the middle arm section 44. FIG. 7 shows horizontally spaced apart guide plates 110 positioned on opposite sides within the outer arm section 42 to form guides for the ends 106 of the middle arm section 44. The lift arm 12 or 14 or 12' may be provided with appropriate stops (not shown) which limit retraction of the middle and inner arm sections 42 and 44 so that inner ends thereof do no contact the pivot tube 67.

The lift arm sections 42, 44, and 46 may be provided with stop members to positively limit extension of the middle arm section 44 out of the outer arm section 42 and the extension of the inner arm section 46 out of the middle arm section 44. More particularly, the outer arm section 42 may be provided with an interior stop member 112 (FIG. 12B) inside a proximal end thereof for engagement by an exterior stop member 114 (FIG. 13) positioned on an upper surface of the middle arm section 44. Similarly, the middle arm section 44 may be provided with an interior stop member 116 for engagement by an exterior stop member 118 positioned on an upper surface of the inner arm section 46. The stop members 114 and 118 may also function as sliding spacers within the respective arm sections 42 and 44.

While the lift units 2 and 3 are described and illustrated as being permanently mounted on a shop floor 5, it is foreseen that features of the system 1 of the present invention described herein could be advantageously incorporated into mobile lift units which are temporarily secured in place in the manner of the lifts shown in U.S. Pat. No. 9,150,395, referenced above.

Figure 14:
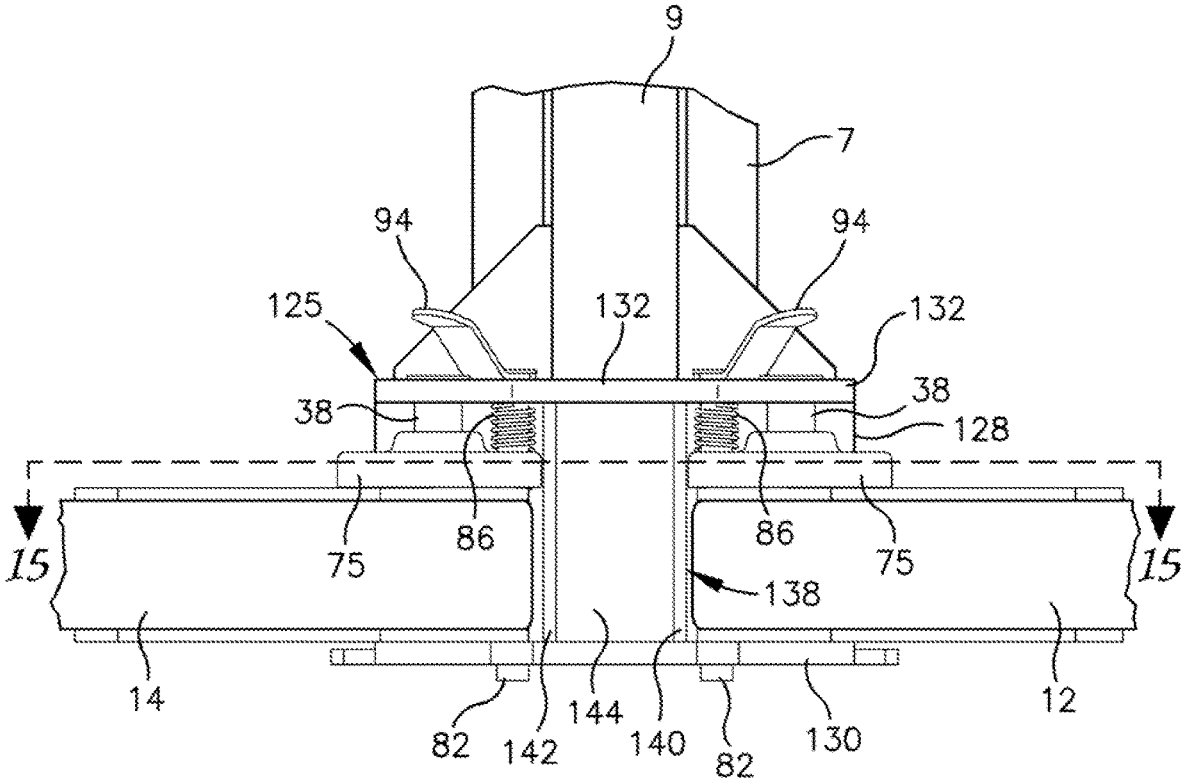
FIG. 14 is a fragmentary inside elevational view of a modified carriage lift clevis with an abutment structure secured therein to limit strain on lock pins of the lift arm assemblies when the rotationally fixed lock members are in their respective locked positions.
Figure 15:
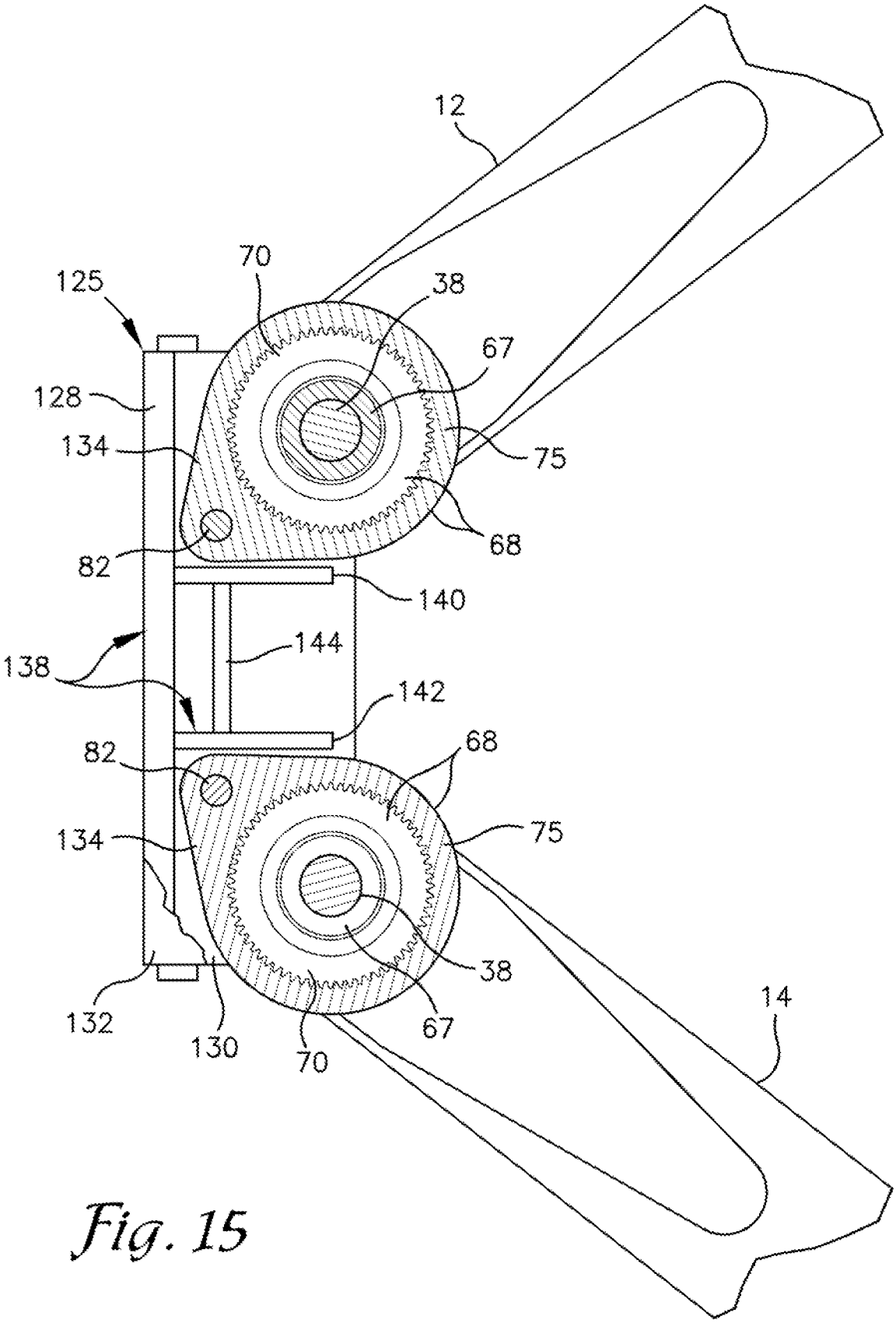
FIG. 15 is a fragmentary horizontal sectional view of the modified lift carriage clevis taken on line 15-15 of FIG. 14 and illustrates details of abutment members of the abutment structure.

Referring to FIGS. 14 and 15, along with FIGS. 10, 12A, and 12B, a modified embodiment of a lift carriage clevis 125 according to the present invention may be secured to the lift carriage 9 in a manner similar to the lift carriage clevis 24 described above. The illustrated clevis 125 is formed by an upstanding side plate 128 which is secured to the lift carriage 9, a horizontally extending lower or bottom plate 130 secured to a bottom of the side plate 128, and a horizontally extending upper or top plate 132 secured to a top of the side plate 128. A fragment of the top plate 132 is shown in FIG. 15.

Proximal ends of the extendible lift arms 12 and 14 are pivotally mounted on the clevis 125 by lift arm pivot pins 38 extending through lift arm mounting tubes 67 (FIGS. 12A and 12B) between the top plate 132 and bottom plate 130 of the clevis 125. The proximal end of each of the lift arms 12 and 14 has the rotatable lock member or gear 70 secured thereto. The rotatable lock member 70 rotates about the pivot axis 65 (FIG. 10) when lift arms 12 or 14 is pivoted relative to the clevis 125. The rotatable lock member 70 cooperates with the rotationally fixed lock member or gear 75 to form the arm lock mechanism 68 which prevents pivoting of a lift arm 12 or 14 when the rotationally fixed gear 75 is in its locked position (FIG. 12A) and to enable pivoting of the lift arms 12 or 14 in the released position (FIG. 12B). The rotationally fixed lock member 75 is prevented from rotating relative to the clevis 125 by the lock pin 82 extending through the top and bottom clevis plates 132 and 132 and through a modified mounting lug 134. The lock pin 82 is capable of axial reciprocation and engages the rotationally fixed lock member 75 in such a manner as to function as function as a release member by being raised, as by a release lever 94 (FIG. 12A or 12B). The lock pin 82 and the rotationally fixed lock member 75 are normally urged toward the locked position by the spring 86.

Because of the lengths of the lift arms 12 or 14, when the rotationally fixed lock member 75 is in the locked position, a force on a distal end thereof which tends to pivot the arm about the pivot pin 38 exerts a much larger force on the lock pin 82, tending to strain or deform the pin 82. If such a force on the lock pin 82 exceeds its elastic limit, permanent deformation of the pin 82 can make reciprocating motion to retract the rotationally fixed lock member 75 difficult or impossible.

In order to bolster or limit such strain on the lock pins 82, the illustrated clevis 125 is provided with abutment structure 138. The clevis side plate 128 may form a component of the abutment structure 138. The lift arms 12 and 14 are mounted on the clevis 125 such that a portion of the mounting lug 134 of the rotationally fixed lock member 75 of each arm is in close proximity to the side plate 128. The mounting lugs 134 are somewhat different from the mounting lugs 80 shown in FIG. 9; however, the lugs 80 would also function with the illustrated abutment structure 138. The clevis side plate 128, thus, limits excessive strain on the lock pins 82 in response to a force on the distal end of the lift arm 12 toward the clockwise direction, as viewed in FIG. 15, or on the distal end of the lift arm 14 toward the counterclockwise direction. To provide a lock pin strain limiting abutment in the opposite pivoting directions, the illustrated clevis 125 is provided with abutment members or plates 140 and 142 which may be secured to the clevis plates 128, 130, and 132, as by welding. The abutment plates 140 and 142 are positioned in close proximity to the lugs 134 of the rotationally fixed lock members 75 to limit strain on the lock pins 82 by a force on the lift arm 12 toward the counterclockwise direction or by a force on the lift arm 14 toward the clockwise direction. The abutment members 140 and 141, along with the clevis side plate 128 should be spaced close enough to the lugs 134 of the rotationally fixed lock members 75 to prevent excessive strain on the lock pins 82, but should not interfere with transition of the lock members 75 between the locked and released positons. Clearance distances between embodiments of the abutment plates 140 and 142 and the rotationally fixed lock members 75 may be on the order of about 3 millimeters. An abutment brace plate 144 may be joined to the abutment plates 140 and 142, near the areas of contact by the lugs 134, to reinforce the abutment plates 140 and 142.

It is to be understood that while certain forms of the present invention have been illustrated and described herein, it is not to be limited to the specific forms or arrangement of parts described and shown.

What is claimed as new and desired to be secured by Letters Patent is:

1. A compact telescoping lift arm assembly for use on a vehicle lift unit including an upstanding post having a lift carriage slidably engaged therewith and movable therealong, the arm assembly comprising:

(a) an outer arm section having an inner end pivotally connected to the lift carriage by a lift arm pivot member such that the outer arm section is pivotal about a pivot axis extending through the lift arm pivot member;

(b) an inner arm section telescopically received within the outer arm section to enable extension of the arm assembly by extension of the inner arm section out of the outer arm section and retraction of the arm assembly by retraction of the inner arm section within the outer arm section;

(c) the inner arm section having an inner end within the outer arm section and an outer end extending out of the outer arm section; and (d) the inner end of the inner arm section having a nesting recess positioned such that the inner end extends past the pivot member, with the pivot member nested in the recess, when the inner arm section is fully retracted within the outer arm section.

2. The assembly as set forth in claim 1 wherein:

(a) the nesting recess is formed by a nesting slot which is open through the inner end of the inner arm section.

3. The assembly as set forth in claim 1 and including:

(a) an intermediate arm section telescopically received within the outer arm section and having the inner arm section telescopically received within the intermediate arm section.

4. The assembly as set forth in claim 1 wherein:

(a) the inner arm section forms an intermediate arm section telescopically received within the outer arm section and having an interior arm section telescopically received within the intermediate arm section, the intermediate arm section having an inner end; and (b) the intermediate arm section having the nesting recess formed at the inner end thereof.

5. The assembly as set forth in claim 1 and including:

(a) a lift arm rotational lock mechanism engaged between the lift arm and the lift carriage and operable to selectively fix an angular position of the lift arm in relation to the lift carriage.

6. The assembly as set forth in claim 5 wherein the lift arm rotational lock mechanism includes:

(a) a lift arm pivot lock member positioned at the inner end of the outer section of the lift arm and rotatable with the outer section of the lift arm about the pivot axis;

(b) a rotationally fixed lift arm lock member engaged with the lift carriage in such a manner as to enable transition between a locked position engaging the lift arm pivot lock member to prevent pivoting of the lift arm and a released position disengaged from the lift arm pivot lock member, the rotationally fixed lock member being resiliently biased toward the locked position; and (c) a release member positioned on the lift carriage and engaged with the rotationally fixed lock member and preventing rotation of the rotationally fixed lock member relative to the lift carriage, the release member being operable to cause the rotationally fixed lock member to temporarily transition from the locked position to the released position to enable pivoting of the lift arm.

7. The assembly as set forth in claim 6 and including:

(a) a release lever engaged with the release member and operable to transition the rotationally fixed lock member between the locked position and the released position.

8. The assembly as set forth in claim 6 and including:

(a) a release lever engaged with the release member and the lift carriage and operable to transition the rotationally fixed lock member between the locked position and the released position;

(b) the release lever having a first lever end engaging the release member and the lift carriage and an opposite second lever end; and (c) the release lever being configured in such a manner that lowering the second lever end causes the release member to move the rotationally fixed lift arm lock member from the locked position to the released position and releasing the second lever end causes the release member to return the rotationally fixed lift arm lock member from the released position to the locked position.

9. The assembly as set forth in claim 6 and including:

(a) a release lever engaged with the release member and the lift carriage and operable to transition the rotationally fixed lock member between the locked position and the released position;

(b) the release lever having a first lever end engaging the release member and the lift carriage and an opposite second lever end; and (c) the release lever having a stretched Z-shape such that lowering the second lever end causes the release member to move the rotationally fixed lock arm member from the locked position to the released position and releasing the second lever end causes the release member to return the rotationally fixed lock arm member from the released position to the locked position.

10. A compact telescoping lift arm assembly for use on a vehicle lift unit including an upstanding post having a lift carriage slidably engaged therewith and movable therealong, the arm assembly comprising:

(a) an outer arm section having an inner end pivotally connected to the lift carriage by a lift arm pivot member such that the outer arm section is pivotal about a pivot axis extending through the lift arm pivot member;

(b) an inner arm section telescopically received within the outer arm section to enable extension of the arm assembly by extension of the inner arm section out of the outer arm section and retraction of the arm assembly by retraction of the inner arm section within the outer arm section;

(c) the inner arm section having an inner end within the outer arm section and an outer end extending out of the outer arm section;

(d) the inner end of the inner arm section having a nesting slot which is open through the inner end of the inner arm section and positioned such that the inner end extends past the pivot member, with the pivot member nested in the nesting slot, when the inner arm section is fully retracted within the outer arm section; and (e) a lift arm rotational lock mechanism engaged between the lift arm and the lift carriage and operable to selectively fix an angular position of the lift arm in relation to the lift carriage.

11. The assembly as set forth in claim 10 and including:

(a) an intermediate arm section telescopically received within the outer arm section and having the inner arm section telescopically received within the intermediate arm section.

12. The assembly as set forth in claim 10 and including:

(a) an intermediate arm section telescopically received within the outer arm section and having the inner arm section telescopically received within the intermediate arm section, the intermediate arm section having the inner end; and (b) the intermediate arm section having a respective nesting recess formed at an inner end thereof.

13. The assembly as set forth in claim 10 wherein the lift arm rotational lock mechanism includes:

(a) a rotatable lock gear positioned on the outer section of the lift arm in coaxial relation to the lift arm pivot member, the rotatable lock gear having rotatable lock gear teeth projecting radially about the rotatable lock gear;

(b) a rotationally fixed lock gear positioned in spaced coaxial relation to the rotatable lock gear, the rotationally fixed lock gear having rotationally fixed lock gear teeth projecting radially about the rotationally fixed lock gear; and (c) the rotationally fixed lock gear teeth of the rotationally fixed lock gear meshing with the rotatable lock gear teeth of the rotatable lock gear when the rotationally fixed lock gear is advanced to a locked position relative to the rotationally fixed lock gear and unmeshing from the rotatable lock gear teeth of the rotatable lock gear when the rotationally fixed lock gear is advanced to a released position relative to the rotationally fixed lock gear.

14. The vehicle lift unit as set forth in claim 13 wherein:

(a) the rotatable lock gear and the rotationally fixed lock gear are respectively conical in such a manner as to enable meshing thereof in the locked position of the rotationally fixed lock member.

15. The assembly as set forth in claim 13 wherein:

(a) the release member prevents rotation of the rotationally fixed lock member about the pivot axis in the locked position thereof; and (b) an abutment member is secured to the lift carriage in close proximity to the rotationally fixed lock member to thereby limit strain of the release member in the locked position of the rotationally fixed lock member by engagement thereof with the abutment member.

16. A vehicle lift unit comprising:

(a) an upstanding post;

(b) a lift carriage slidably engaging and movable along the post;

(c) a linear motor engaged between the carriage and the post and operable to lift and lower the carriage therealong;

(d) a telescoping lift arm including an outer arm section having an inner end pivotally connected to the carriage by a lift arm pivot member such that the outer arm section is pivotal about a pivot axis extending through the lift arm pivot member; the telescoping lift arm further including an inner arm section telescopically received within the outer arm section to enable extension of the lift arm by extension of the inner arm section out of the outer arm section and retraction of the lift arm by retraction of the inner arm section within the outer arm section;

(e) the inner arm section having an inner end within the outer arm section and an outer end extending out of the outer arm section, the outer end having a vehicle engagement member for contact with a vehicle to lift the vehicle; and (f) the inner end of the inner arm section having a nesting slot positioned such that the inner end extends past the pivot member, with the pivot member nested in the slot, when the inner arm section is fully retracted within the outer arm section.

17. The vehicle lift unit as set forth in claim 16 and including:

(a) a lift arm pivot lock member positioned at the inner end of the outer section of the lift arm and rotatable with the outer section of the lift arm about the pivot axis;

(b) a rotationally fixed lift arm lock member engaged with the lift carriage in such a manner as to enable transition between a locked position engaging the lift arm pivot lock member to prevent pivoting of the lift arm and a released position disengaged from the lift arm pivot lock member, the rotationally fixed lock member being resiliently biased toward the locked position; and (c) a release member positioned on the lift carriage and engaged with the rotationally fixed lock member and preventing rotation of the rotationally fixed lock member relative to the lift carriage, the release member being operable to cause the rotationally fixed lock member to temporarily transition from the locked position to the released position to enable pivoting of the lift arm.

18. The vehicle lift unit as set forth in claim 17 wherein:

(a) the release member prevents rotation of the rotationally fixed lock member about the pivot axis in the locked position thereof; and (b) an abutment member is secured to the lift carriage in close proximity to the rotationally fixed lock member to thereby limit strain of the release member in the locked position of the rotationally fixed lock member by engagement thereof with the abutment member.

19. A vehicle lift unit comprising:

(a) an upstanding post;

(b) a lift carriage slidably engaging and selectively movable along the post;

(c) an elongated lift arm having an inner end pivotally connected to the carriage by a lift arm pivot member to enable pivoting about a pivot axis;

(d) a lift arm pivot lock member secured at the inner end of the arm and rotatable with the arm about the pivot axis;

(e) a rotationally fixed lift arm lock member engaged with the lift carriage in such a manner as to enable transition between a locked position engaging the lift arm pivot lock member to prevent pivoting of the arm and a released position disengaged from the lift arm pivot lock member;

(f) a release member engaged between the lift carriage and the rotationally fixed lock member and preventing rotation of the rotationally fixed lock member relative to the lift carriage, the release member being operable to transition the rotationally fixed lock member between the locked position and the released position; and (g) an abutment member positioned on the lift carriage in close proximity to the rotationally fixed lock member to thereby limit strain of the release member in the locked position of the rotationally fixed lock member by engagement thereof with the abutment member.

20. The vehicle lift unit as set forth in claim 19 wherein:

(a) the release member is an elongated release pin which reciprocates axially to move the rotationally fixed member between the locked position and the released position.

21. The vehicle lift unit as set forth in claim 19 wherein:

(a) the abutment member is an abutment plate secured to the lift carriage in close proximity to the rotationally fixed lock member.

22. The vehicle lift unit as set forth in claim 19 wherein:

(a) the lift arm pivot lock member includes a rotatable arm lock gear positioned on the inner end of the lift arm in coaxial relation to the lift arm pivot member, the rotatable lock gear having rotatable lock gear teeth projecting radially about the rotatable lock gear;

(b) the rotationally fixed lift arm pivot lock member includes a rotationally fixed lock gear positioned in spaced coaxial relation to the rotatable lock gear, the rotationally fixed lock gear having rotationally fixed lock gear teeth projecting radially about the rotationally fixed lock gear;

(c) the rotationally fixed lock gear meshes with the rotatable lock gear in the locked position of the rotationally fixed lock member and unmeshes from the rotatable lock gear in the released position of the rotationally fixed lock member; and (d) the abutment member is positioned in close proximity to the rotationally fixed lock gear.

23. The vehicle lift unit as set forth in claim 19 wherein:

(a) the lift carriage has a pair of lift arms pivotally connected thereto in spaced relation at respective inner ends of the lift arms by respective pivot members to enable pivoting about respective pivot axes;

(b) each lift arm having a respective pivot lock member secured at the inner end thereof and rotatable with the respective lift arm about the respective pivot axis of the respective lift arm;

(c) each lift arm having a respective rotationally fixed arm lock member engaged with the lift carriage in such a manner as to enable transition between a locked position engaging the associated lift arm pivot lock member to prevent pivoting of the respective lift arm and a released position disengaged from the associated lift arm pivot lock member;

(d) each lift arm having a respective release member engaged between the lift carriage and the associated rotationally fixed lock member and preventing rotation of the fixed lock member about the associated pivot axis in the locked position thereof, the release member being operable to transition the fixed lock member between the locked and released positions thereof; and (e) a pair of abutment plates associated respectively with the lift arms and secured to the lift carriage in close proximity to the rotationally fixed lock member of the associated lift arm to limit strain of the release member associated therewith in the locked position of the fixed lock member by engagement thereof with the associated abutment plate.

24. The vehicle lift unit as set forth in claim 23 wherein:

(a) the abutment plates are secured to the lift carriage in spaced apart relation; and (b) a reinforcement plate extends between the abutment plates and is secured thereto and to the lift carriage.

25. A lift arm assembly for use on a vehicle lift unit including an upstanding post with a lift carriage movable therealong, the arm assembly comprising:

(a) an elongated lift arm having an inner end pivotally connected to the carriage by a lift arm pivot member to enable pivoting about a pivot axis;

(b) a rotatable arm lock gear secured on the inner end of the lift arm in coaxial relation to the lift arm pivot member, the rotatable lock gear having rotatable lock gear teeth projecting radially about substantially an entire circumferential surface thereof;

(c) a rotationally fixed lock gear supported by the lift carriage in spaced coaxial relation to the rotatable lock gear, the rotationally fixed lock gear having rotationally fixed lock gear teeth projecting radially about substantially an entire circumferential surface of the rotationally fixed lock gear, the rotationally fixed lock gear having a mounting lug extending radially therefrom;

(d) the rotationally fixed lock gear meshing with the rotatable lock gear in a locked position of the rotationally fixed lock gear and unmeshing from the rotatable lock gear in a released position of the rotationally fixed lock gear; and (e) a release member engaged with the lift carriage and with the mounting lug of rotationally fixed lock gear, positioned in radially spaced relation from the pivot axis, and preventing rotation of the rotationally fixed lock gear relative to the lift carriage; and (f) the release member being operable to transition the rotationally fixed lock member between the locked position and the released position.

26. The assembly as set forth in claim 25 and including:

(a) a spring engaged with the rotationally fixed lock gear in such a manner as to normally urge the rotationally fixed lock gear toward the locked position.

27. The assembly as set forth in claim 25 and including:

(a) a spring engaged between the lift carriage and the rotationally fixed lock gear in such a manner as to normally urge the rotationally fixed lock gear toward the locked position.

28. The assembly as set forth in claim 25 and including:

(a) an abutment member positioned on the lift carriage in close proximity to the rotationally fixed lock member to thereby limit strain of the release member in the locked position of the rotationally fixed lock member by engagement thereof with the abutment member.

29. The assembly as set forth in claim 25 wherein the elongated lift arm is a telescoping lift arm and includes:

(a) an outer arm section having an inner end pivotally connected to the lift carriage by the lift arm pivot member such that the outer arm section is pivotal about the pivot axis extending through the lift arm pivot member;

(b) an inner arm section telescopically received within the outer arm section to enable extension of the arm assembly by extension of the inner arm section out of the outer arm section and retraction of the arm assembly by retraction of the inner arm section within the outer arm section;

(c) the inner arm section having an inner end within the outer arm section and an outer end extending out of the outer arm section; and (d) the inner end of the inner arm section having a nesting recess positioned such that the inner end extends past the pivot member, with the pivot member nested in the recess, when the inner arm section is fully retracted within the outer arm section.

* * * * *